US006305780B1

(12) United States Patent
Askren et al.

(10) Patent No.: US 6,305,780 B1
(45) Date of Patent: Oct. 23, 2001

(54) CARRIAGE DRIVE SYSTEM FOR A SERIAL PRINTER WHICH MINIMIZES REGISTRATION ERRORS

(75) Inventors: Benjamin Alan Askren; Michael Scott Leiter, both of Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/516,842

(22) Filed: Mar. 2, 2000

(51) Int. Cl.[7] ..... B41J 23/00
(52) U.S. Cl. ..... 347/37; 347/14
(58) Field of Search ..... 347/5, 9, 14, 37

(56) References Cited

U.S. PATENT DOCUMENTS

| | | | |
|---|---|---|---|
| Re. 30,440 | 12/1980 | Jeffrey . | |
| 2,507,852 | 5/1950 | Case | 474/148 |
| 2,934,967 | 5/1960 | Worrall, Jr. | 424/148 |
| 4,131,898 | 12/1978 | Gamblin | 347/41 |
| 4,232,324 | 11/1980 | Tsao | 347/41 |
| 4,378,965 | 4/1983 | Ishii et al. | 474/161 |
| 4,401,991 | 8/1983 | Martin | 347/41 |
| 4,915,674 | 4/1990 | Tanaka et al. | 474/153 |
| 5,109,239 | 4/1992 | Cobbs et al. | 347/19 |
| 5,151,716 | 9/1992 | Kanemitsu . | |
| 5,200,767 | 4/1993 | Tsukada et al. | 346/139 R |
| 5,264,769 | 11/1993 | Itoh | 318/685 |
| 5,421,789 | 6/1995 | Gregg | 474/153 |
| 5,797,691 | 8/1998 | Suzuki | 400/320 |
| 5,914,736 * | 6/1999 | Tamura | 347/37 |
| 6,045,212 * | 4/2000 | Ruhe et al. | 347/37 |

* cited by examiner

*Primary Examiner*—John Barlow
*Assistant Examiner*—Craig A. Hallacher
(74) *Attorney, Agent, or Firm*—Taylor & Aust, P.C.

(57) ABSTRACT

A carriage drive system for use in a serial printer includes a carriage movable in transverse directions across a print medium. Each of the transverse directions is substantially perpendicular to a print medium feed direction. A print cartridge is releasably mounted on the carriage and has at least one printhead. The at least one printhead has at least one ink jetting nozzle for jetting ink. The at least one ink jetting nozzle cyclically jets the ink at at least one jetting frequency. A carriage belt is mechanically coupled to the carriage. A transverse drive system drives the carriage belt in the transverse directions. A drive motor is coupled to the drive system. At least one cyclical disturbance exists due to the operation of the carriage belt, the drive system and/or the motor. The at least one cyclical disturbance has at least one disturbance frequency. At least one of the disturbance frequencies is an integer multiple of at least one of the jetting frequencies.

26 Claims, 7 Drawing Sheets

CARRIAGE DRIVE SYSTEM FOR A SERIAL PRINTER WHICH MINIMIZES REGISTRATION ERRORS

BACKGROUND OF THE INVENTION

1. Field of the Invention

The present invention relates to serial printers, and, more particularly, to a carriage drive system for a serial printer.

2. Description of the Related Art

Printers with carriage drive systems ("serial printers") are of a type that drive a printhead driver or firing mechanism ("printhead") which is generally attached to a frame mechanism, called a carriage or carrier, which moves the printhead back and forth at a given distance from the print media while printing takes place. An ink jet printer is an example of such a serial printer. Carriage drive systems suffer from a number of cyclical disturbances which cause velocity fluctuations during printing. These velocity fluctuations, in turn, cause print registration errors in the final output of the printer. Any system that moves a carriage at a given steady-state velocity will generate disturbances at given, repeatable spatial frequencies in addition to general noise. An example unit would be cycles per inch or cycles per millimeter.

In order to increase the quality of the final print, an attempt is made to drive the carriage in a perfectly smooth manner, with no changes to yaw, pitch, or roll of the carriage assembly while printing. If there are any disturbances introduced into the system, additional, non-ideal error velocity components can be introduced to the printhead, resulting in print registration errors in the final print on the output media. Some specific frequencies that are often a problem are the motor pole and commutation frequencies, timing belt tooth disturbances, and gear or pulley tooth disturbances from any gear or pulley systems in the drive train.

One approach to dealing with these disturbances is to change the system mechanically to dampen out the disturbances affecting the carriage, or otherwise attenuate the disturbances until the system is able to achieve its print registration accuracy requirements. This could take the form of better quality components which create less disturbance, altering the characteristics of the carriage, carriage drive belt, etc., to attenuate the disturbances, or some other such scheme. Alternately, sensors could be used to determine what the disturbances are in real time and adjust the print firings to compensate for them. A problem with all of these known approaches is that they add cost to the printer and/or are detrimental to other aspects of printer performance.

What is needed in the art is a method of improving print registration which does not add to the cost of the printer and does not degrade printer performance.

SUMMARY OF THE INVENTION

The present invention provides a method of reducing print registration errors without incurring the costs involved in reducing the level of underlying disturbances that are introduced into the printhead carriage mechanism during printing.

The present invention provides a system of optimal physical printhead element spacings (for multiple elements placed parallel to the direction of carriage motion), optimal belt tooth and motor designs, and optimal gear train/reduction ratios that reduce or eliminate some or all of the effects of the disturbances in the system on print registration. These optimal mechanical designs can be used separate from, or in conjunction with, any other disturbance reduction method.

The present invention comprises, in one form thereof, a carriage drive system for use in a serial printer. A carriage is movable in transverse directions across a print medium. Each of the transverse directions is substantially perpendicular to a print medium feed direction. A print cartridge is releasably mounted on the carriage and has at least one printhead. The at least one printhead has at least one ink jetting nozzle for jetting ink. The at least one ink jetting nozzle cyclically jets the ink at at least one jetting frequency. A carriage belt is mechanically coupled to the carriage. A transverse drive system drives the carriage belt in the transverse directions. A drive motor is coupled to the drive system. At least one cyclical disturbance exists due to the operation of the carriage belt, the drive system and/or the motor. The at least one cyclical disturbance has at least one disturbance frequency. At least one of the disturbance frequencies is an integer multiple of at least one of the jetting frequencies.

An advantage of the present invention is that print registration is improved without the cost of designing the printer such that the inherent disturbances within the printer are reduced.

Another advantage is that print registration can be improved at any given level of cyclical disturbances within the printer.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
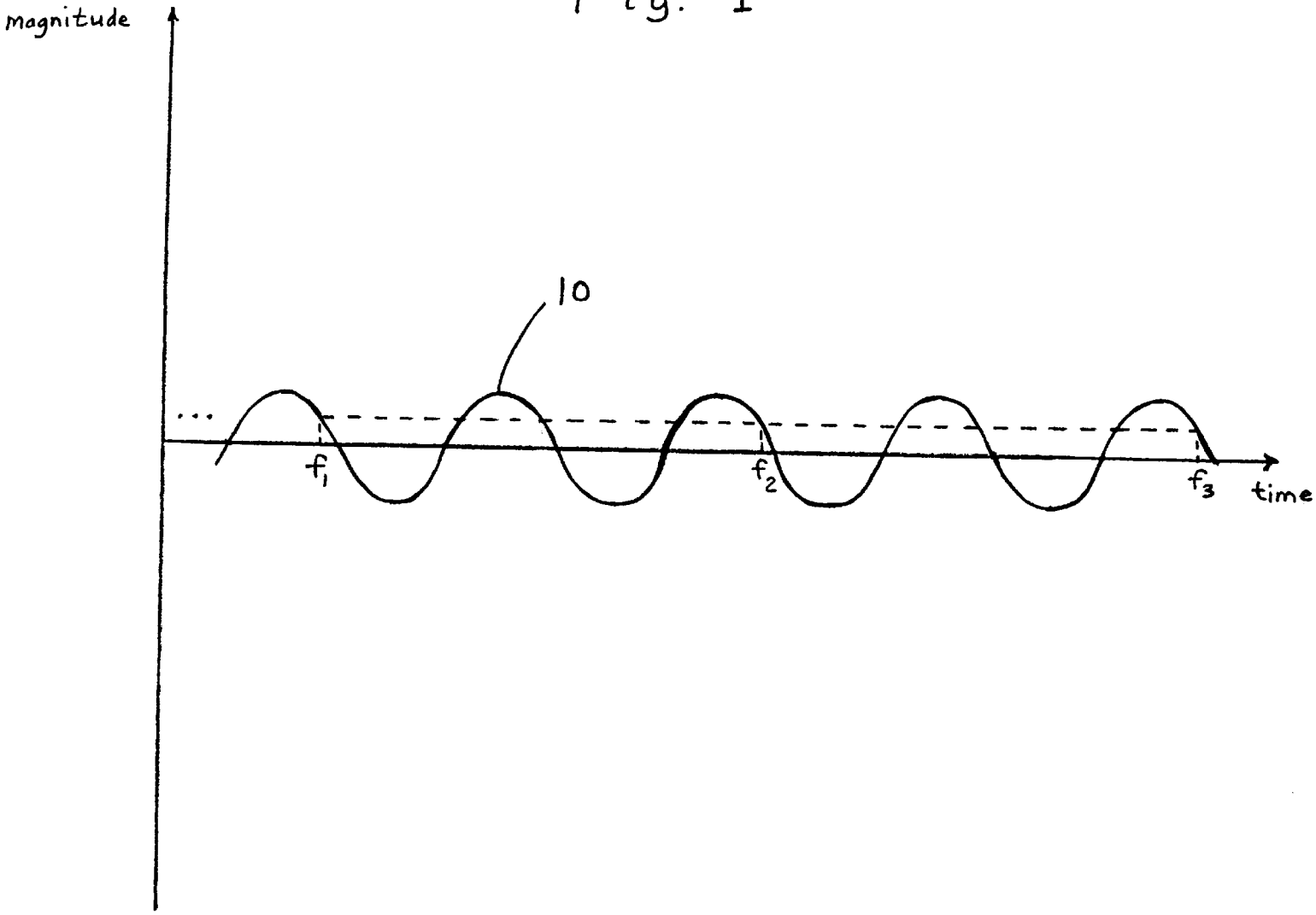
FIG. 1 is a plot of a timing relationship between a cyclical disturbance and print firings that occurs in one embodiment of the present invention.

The present invention is a method of designing the mechanical construct of a serial printer's carriage drive system so that all vital print firings occur at the same phase of the cyclically repeating disturbances produced during operation of the carriage drive system. That is, all disturbances are at frequencies such that all print firings occur in the same phase of each disturbance as printing/sensing occurs. Such a timing relationship between the print firings and a cyclical disturbance is shown in FIG. 1. In FIG. 1, the cyclical disturbance is represented by a sinusoidal waveform 10, and print firings occur at times f1, f2 and f3. As is evident from the drawing, the frequency of the disturbance 10 is twice the frequency of the firings such that each firing occurs at a same point in the phase of sinusoidal disturbance 10. This timing relationship between the print firings and the cyclical disturbances results in a reduction in the relative error from one dot to the next on the printed page, since a disturbance affects each firing to a same extent.

A carriage drive system for achieving the timing relationship of FIG. 1 includes a carriage 12 (FIG. 2), a carriage belt 14, a transverse drive system 16 and a drive motor 18. Carriage 12 is slidably supported on at least one guide rod 19 of a printer frame 21. Carriage 12 carries print cartridges 20, 22, 24 and 26 (FIG. 3) having respective printheads 28, 30, 32 and 34. Each of printheads 28, 30, 32 and 34 includes a respective plurality of printing elements in the form of ink jetting nozzles, only two of which are shown in each printhead for clarity of illustration. More particularly, printhead 28 includes nozzles 36, 38; printhead 30 includes nozzles 40, 42; printhead 32 includes nozzles 44, 46; and printhead 34 includes nozzles 48, 50. All of the nozzles are aligned in the direction indicated by double arrow 52.

Figure 3:
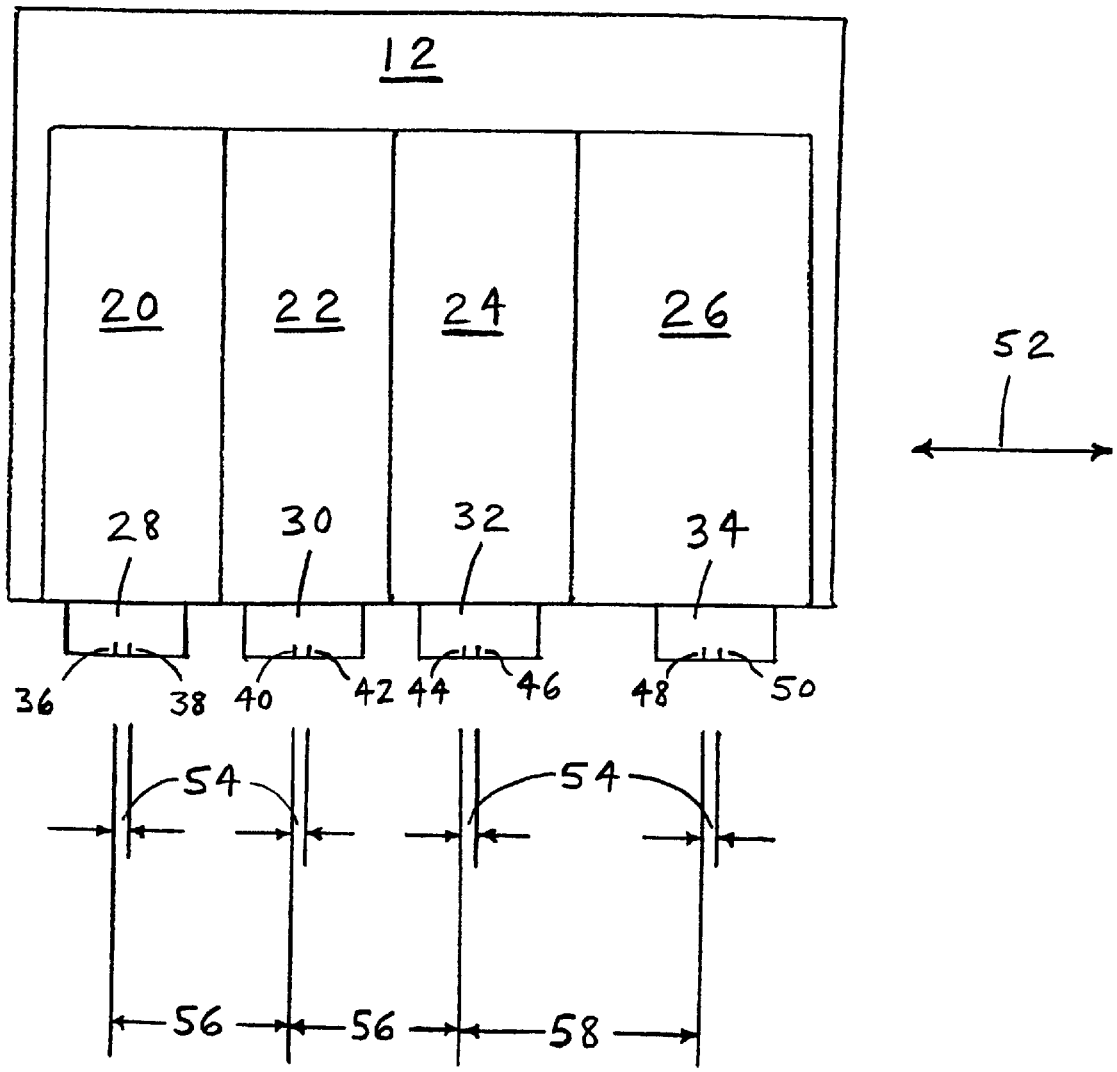
FIG. 3 is a schematic view of the carriage of FIG. 2 carrying one embodiment of the print cartridges of the carriage drive system of the present invention.

Each ink-jetting nozzle is separated from the other nozzle on the same printhead by an intra-cartridge nozzle separation distance 54. Further, nozzle 36 is separated from nozzle 40 by a first inter-cartridge nozzle separation distance 56, and nozzle 40 is separated from nozzle 44 by the same nozzle separation distance 56. As can be seen in FIG. 3, print cartridge 26 is wider in direction 52 than is any of print cartridges 20, 22, 24. The reasons for the extra width of print cartridge 26 may be that print cartridge 26 contains a more commonly used color of toner, such as black, and hence is configured to contain a greater quantity of toner so that its useful life between replacements is lengthened. Because of the extra width of print cartridge 26, a second inter-cartridge nozzle separation distance 58 between nozzle 44 and nozzle 48 is greater than distance 56.

Figure 2:
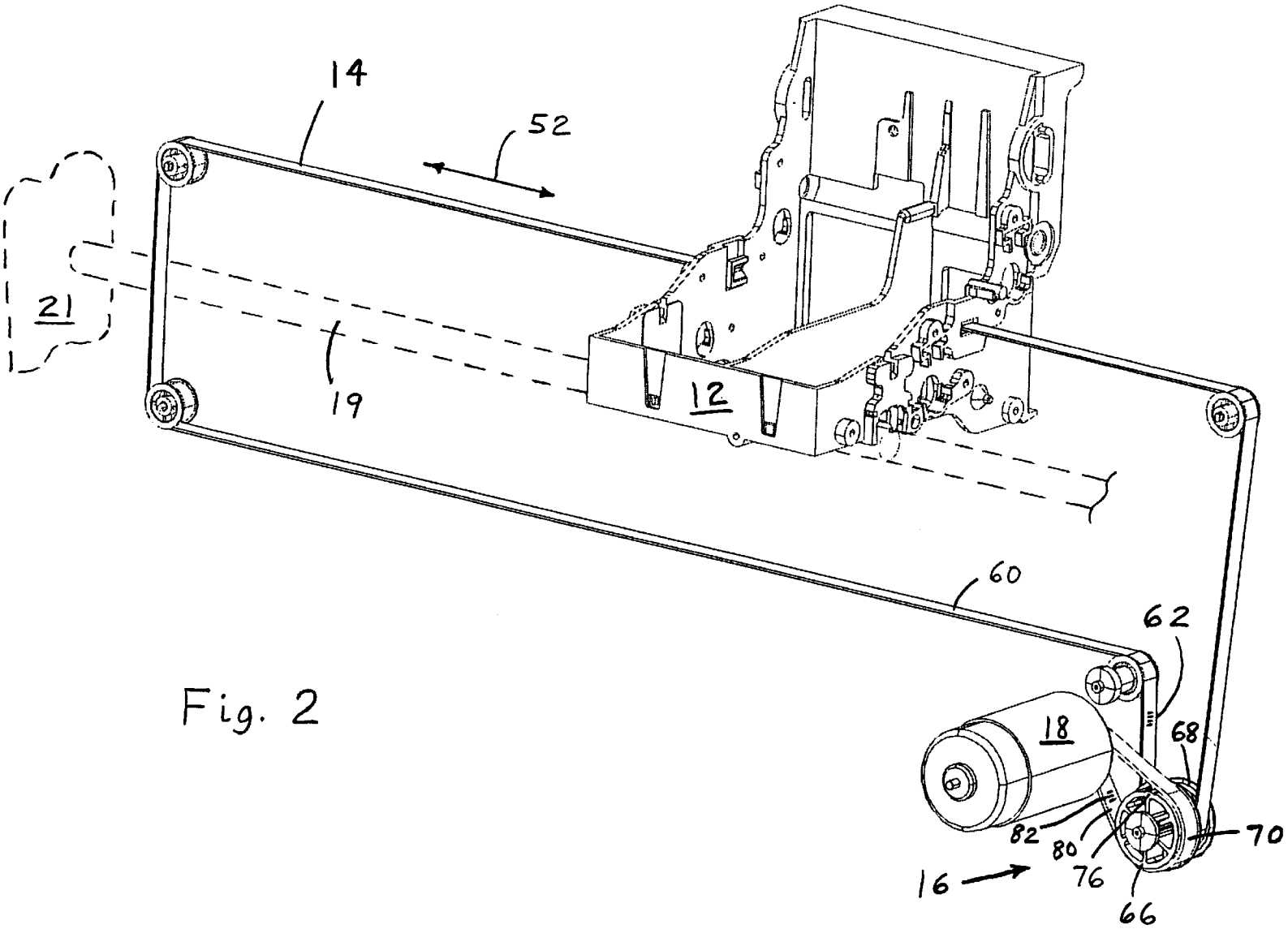
FIG. 2 is a front perspective view of a carriage, carriage belt, transverse drive system and drive motor of one embodiment of a carriage drive system of the present invention.
Figure 4:
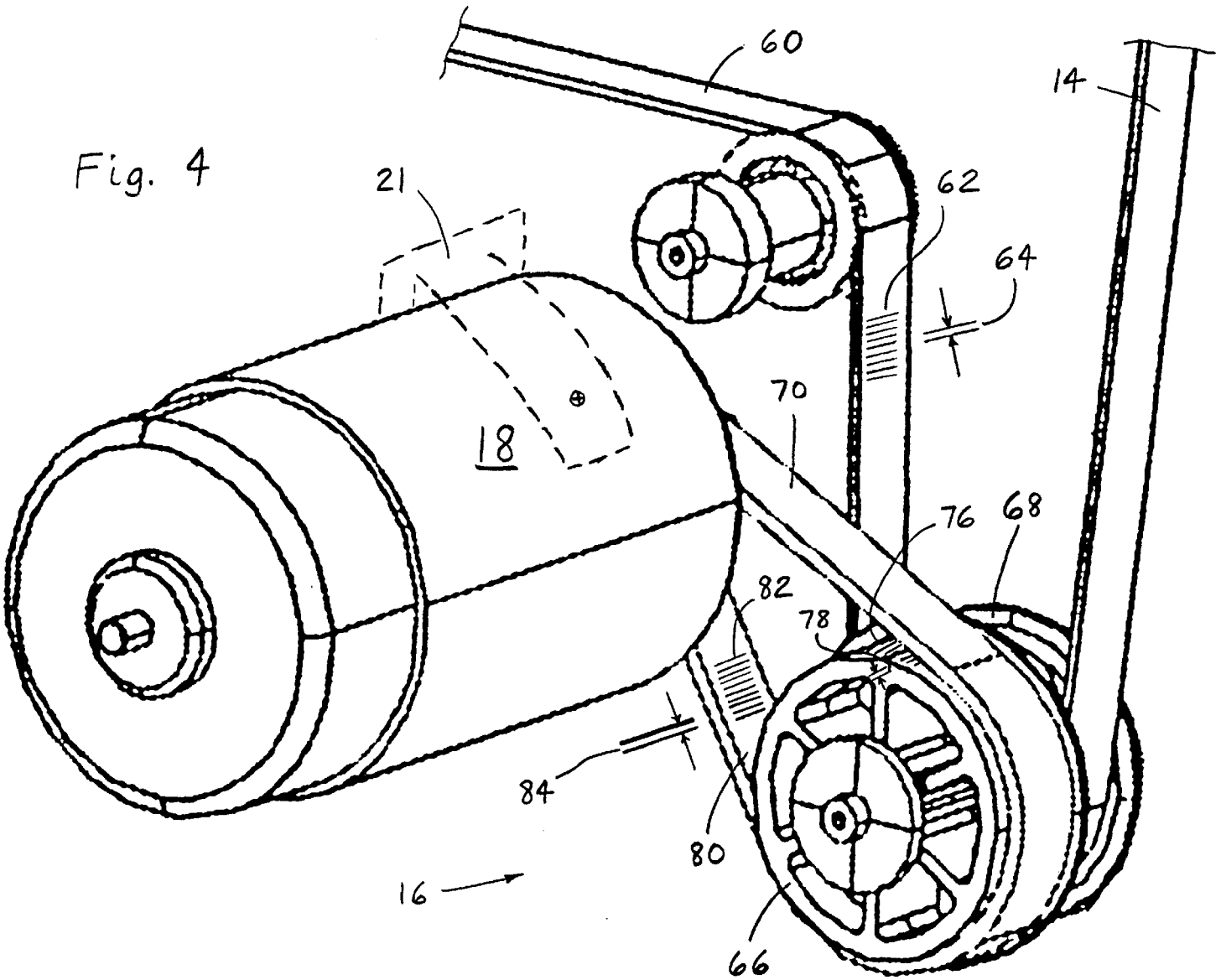
FIG. 4 is an enlarged, fragmentary, front perspective view of the carriage belt, transverse drive system and drive motor of FIG. 2.

Carriage belt 14 is mechanically coupled to carriage 12 in order to carry carriage 12 in directions 52 as belt 14 is driven by transverse drive system 16 in directions 52. An inside surface 60 of carriage belt 14 includes a plurality of belt teeth 62, which are best seen in FIG. 4. Teeth 62 can be provided along substantially the entire length of inside surface 60, however only a limited number of teeth 62 are shown in FIGS. 2 and 4 for clarity of illustration. Each belt tooth 62 is separated from an adjacent belt tooth 62 by a belt tooth pitch distance 64.

Figure 5:
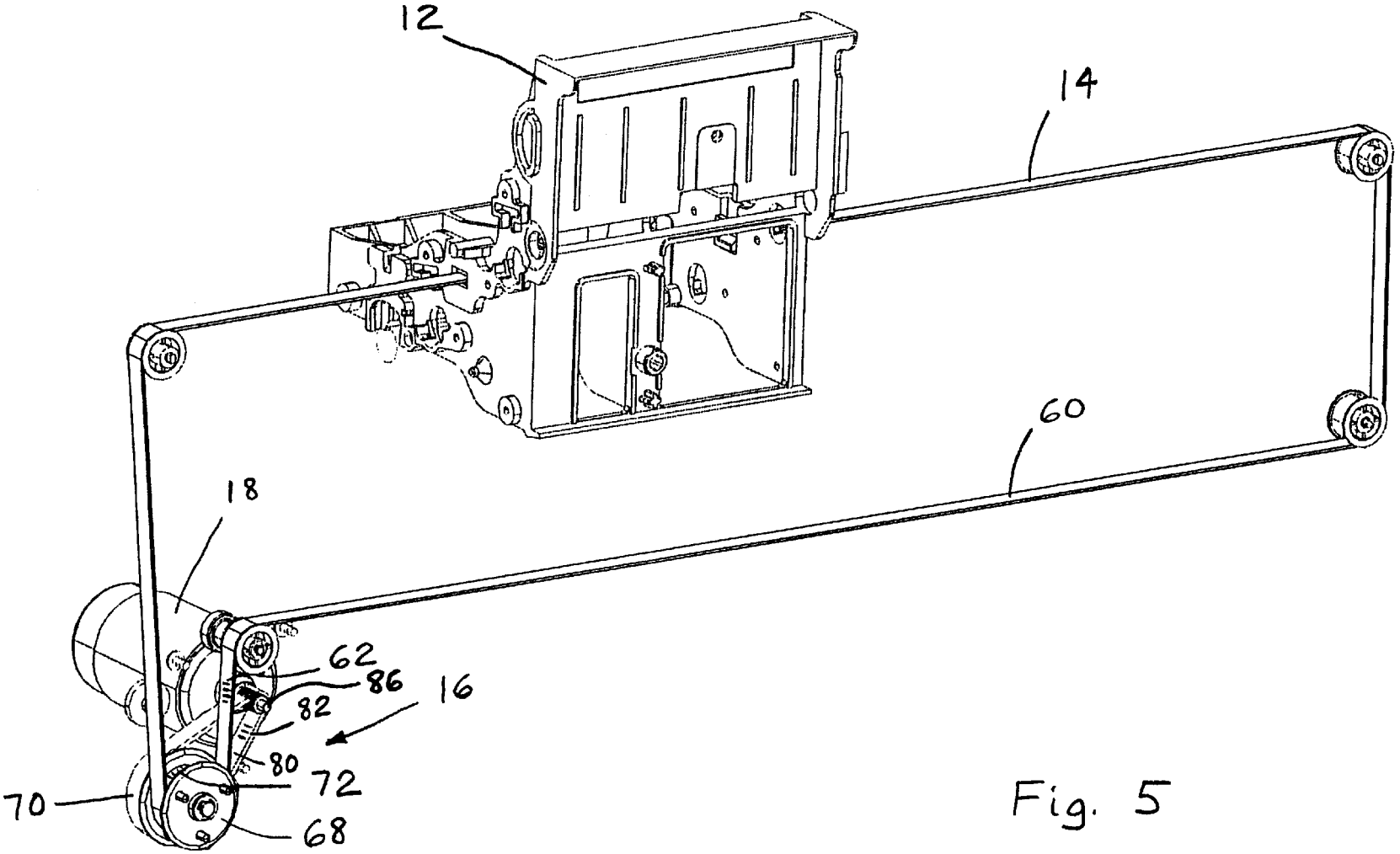
FIG. 5 is a rear perspective view of the carriage, carriage belt, transverse drive system and drive motor of FIG. 2.
Figure 6:
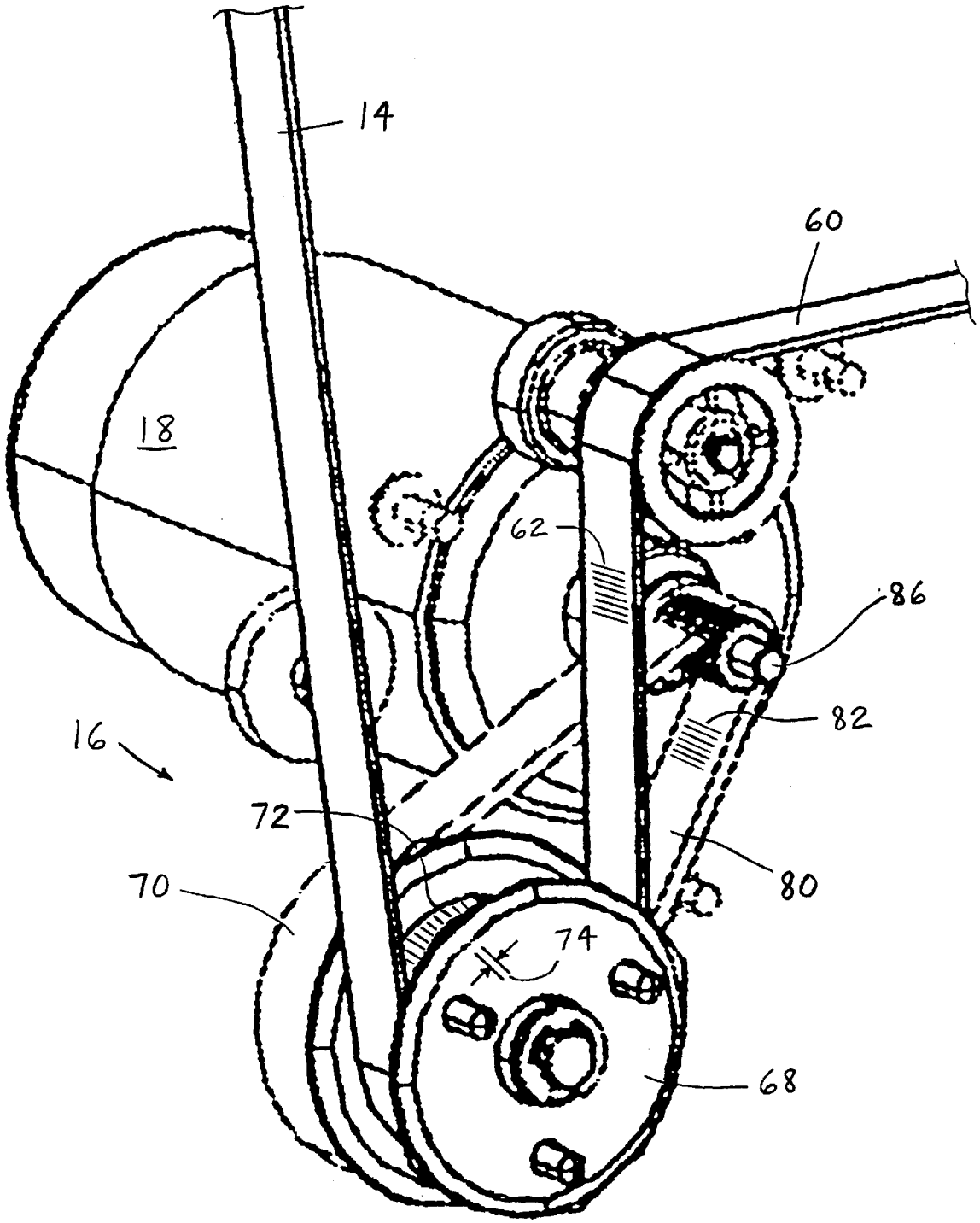
FIG. 6 is an enlarged, fragmentary, rear perspective view of the carriage belt, transverse drive system and drive motor of FIG. 2.

Transverse drive system 16 includes a first pulley 66 mechanically coupled to a second pulley 68 and to a pulley belt 70. Second pulley 68 has a plurality of pulley teeth 72 (FIG. 5) which engage belt teeth 62. Each pulley tooth 72 is separated from an adjacent pulley tooth 72 by a pulley tooth pitch distance 74 (FIG. 6).

First pulley 66 has a plurality of pulley teeth 76, each of which is separated from an adjacent pulley tooth 76 by a pulley tooth pitch distance 78. An inside surface 80 of pulley belt 70 includes a plurality of pulley teeth 82. Teeth 82 can be provided along substantially the entire length of inside surface 80, however only a limited number of teeth 82 are shown in FIGS. 2 and 4–6 for clarity of illustration. Each pulley tooth 82 is separated from an adjacent pulley tooth 82 by a pulley tooth pitch distance 84. Pitch distances 64, 74, 78 and 84 may all be equal to or different from each other.

An output shaft 86 of drive motor 18 is mechanically coupled to inside surface 80 of pulley belt 70. Drive motor 18 is fixedly mounted to frame 21.

In operation, rotation of output shaft 86 causes pulley belt 70 to rotate, in turn causing first pulley 66 and second pulley 68 to rotate. Rotation of second pulley 68 causes carriage belt 14 to rotate, resulting in carriage 12 being driven along guide rod 19 by the movement of belt 14 in one of the directions of double arrow 52. The direction of rotation of motor 18 (clockwise or counterclockwise) determines which of the two directions of double arrow 52 that carriage 12 moves in, as is well known.

With all nozzles 36, 38, 40, 42, 44, 46, 48 and 50 aligned parallel to the carriage motion directions of arrow 52, all cyclical disturbances caused by belt teeth 62, 82, pulley teeth 72, 76, pole and commutation frequencies of motor 18, etc., should ideally be in synchronization with the firings of the nozzles such that firings occur at the same point in the cycles of each disturbance, as illustrated in FIG. 1. For example, belt tooth pitch distance 64 between adjacent pulley teeth 62 should be a divisor of the greatest common divisor of the distances that the nozzles are apart from each other. It is ideal, therefore, to design the distances between the nozzles to be as large as possible, which allows disturbances with larger periods to be attenuated using the method of the present invention. It is to be understood that the term "divisor", as used herein, is intended to describe a number or quantity that divides another without a remainder, i.e., an integral divisor. For example, ¼ is a divisor of ¾ since ¾ divided by ¼ equals 3, an integer without a remainder.

In a simple hypothetical example to illustrate the present invention, a thermal inkjet printhead 88 (FIG. 7) has just three nozzles or firing elements 90, 92, 94, each which fires dots relative to the other two. Nozzles 90 and 92 are $^{20}/_{600}$" apart, and nozzles 92 and 94 are $^{16}/_{600}$" apart. There are three distances to deal with: $^{20}/_{600}$" (the distance from nozzle 90 to nozzle 92), $^{16}/_{600}$" (the distance from nozzle 92 to nozzle 94), and $^{36}/_{600}$" (the distance from nozzle 90 to nozzle 94). In the method of the present invention, all belt tooth pitch distances, pulley tooth pitch distances, gear tooth pitch distances, and any other dimensions which create cyclical disturbances, are designed in dependence upon the above nozzle separation distances.

One embodiment of the present invention includes designing a custom drive-belt tooth pitch that minimizes print registration errors in the output of a serial printer that are caused by belt tooth disturbances. A custom belt-tooth pitch can create zero phase errors between multiple elements of a printhead in a serial printer design. In order to create a zero phase error between multiple printhead elements along the axis of printhead motion, the belt pitch should be a divisor of the greatest common divisor of all the distances from each firing element to another. For instance, with printhead 88, a belt provided with a pitch of $^{4}/_{600}$", or any other divisor of $^{4}/_{600}$" (such as $^{2}/_{600}$", or $^{1}/_{600}$"), would meet the criteria specified to achieve zero phase error between all the elements when fired.

In a second embodiment of the present invention, a gear train and drive pulley design creates an optimal spatial frequency for motor and gear cogging disturbances to minimize print registration errors that occur in the output of a serial printer. Torque cogging in a servo drive system and its gear train often causes position and velocity disturbances on the printhead carriage of a servo system, as well as periodic velocities in the yaw, pitch, and roll of the driven element. In order to minimize the effect of these disturbances on print quality, a zero phase error is created between the cogging disturbances of the drive system and the printhead elements. Careful selection of the gear ratio, number of teeth per gear or pulley per stage, taken in consideration with the originating source of each disturbance, allows the design of a drive system wherein all disturbances achieve zero phase error between the firings of any of the print elements.

In a third embodiment of the present invention, the distances from pen-to-pen on a multiple-pen printing system are set to values which minimize the print registration error that occur in the output of a serial printer due to various disturbances in the system. In order to have zero phase error in a multiple-element serial printer design (the consideration here being of multiple print elements on the printhead, separated by a distance along the axis of the direction of motion of the printhead(s)), the period of the cyclical pen firings must be an integer multiple of the period of each of the cyclical disturbances in the system. That is, the distance between all of the printing elements along an axis that is parallel to the direction of motion must be an integer multiple of the distances between adjacent disturbance-causing elements in the system that move at the same surface speed as the printing elements.

Some adjustment is need in the case where adjacent disturbance-causing elements do not move at the same surface speed as the printing elements. For example, carriage belt 14 and second pulley 68 clearly both move with a surface speed equal to the scanning speed of print cartridges 20, 22, 24 and 26. However, if the circumference of first pulley 66 were smaller or larger than the circumference of second pulley 68, then the speed of the peripheral surface that carries pulley teeth 76 of first pulley 66 would not be equal to the scanning speed of print cartridges 20, 22, 24 and 26. In this case, the difference between the surface speed of first pulley 66 and the speed of print cartridges 20, 22, 24 and 26 would have to be taken into account when calculating a pulley tooth pitch distance 78 which minimizes print registration errors. A similar adjustment would need to be made for any other disturbance-causing element, such as within motor 18, which does not move at the same speed as carriage 12.

Figure 7:
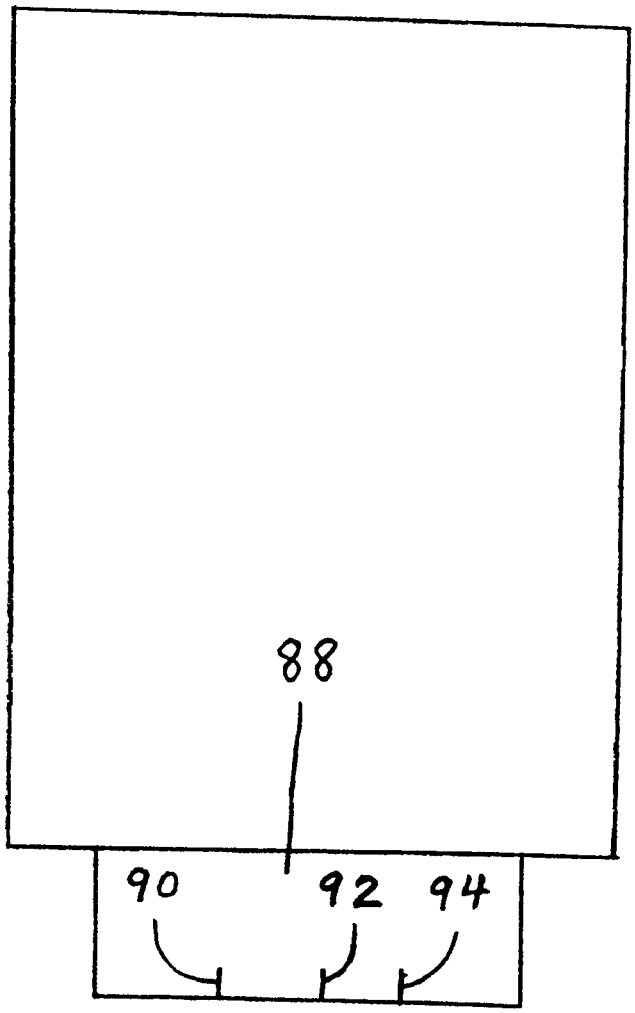
FIG. 7 is a schematic view of another embodiment of a printhead to which the method of the present invention may be applied.

In the embodiment of FIG. 7, all belt tooth pitch distances, pulley tooth pitch distances, gear tooth pitch distances, and any other distance which creates a cyclical disturbance, is crafted to be a divisor of $^{4}/_{600}$", the greatest common divisor of $^{16}/_{600}$", $^{20}/_{600}$", and $^{36}/_{600}$", to create zero phase error between nozzles 90, 92 and 94. As described above, a compensating adjustment to the disturbance-causing dimensions needs to be made if the disturbance-causing elements do not move at the same speed as printhead 88. In general, however, zero phase error between nozzles 90, 92 and 94 can be achieved if the frequencies of all disturbances are integer multiples of the frequency with which nozzles 90, 92 and 94 eject ink.

In the more complex example of FIG. 3, assume that the circumferences of first pulley 66 and second pulley 68 are equal, intra-cartridge separation distance 54 is $^{12}/_{400}$", first inter-cartridge separation distance 56 is $^{102}/_{400}$", and second inter-cartridge distance 58 is $^{150}/_{400}$". Since the greatest common divisor of $^{12}/_{400}$", $^{102}/_{400}$" and $^{150}/_{400}$" is $^{6}/_{400}$", belt tooth pitch distances 64, 84 and pulley tooth pitch distances 74 and 78 should all be made to be divisors of $^{6}/_{400}$" in order to minimize print registration errors.

Further assume that carriage 12 scans across a sheet of paper at a speed of $^{12}/_{400}$" per millisecond and that adjacent nozzles 48 and 50 each jet ink onto a same pixel location. In this case, the jetting frequency is 1 jet/msec or 1000 Hz as calculated by the formula:

Jetting frequency=carriage speed/distance between nozzles, which is calculated in this case as [($^{12}/_{400}$"/msec)/($^{12}/_{400}$")]=1/msec. In order to minimize print registration errors, the system should be designed such that all cyclical disturbances have a frequency that is an integer multiple of 1000 Hz.

In each of these cases, it may not be possible to choose an optimal system due to physical constraints in the system or other causes, or it may not be desirable to implement every optimization due to cost, performance, or other factors. In such a case, costs and benefits must be assigned to each disturbance (effect on final output and other benefits vs. problems with implementation and other costs), and use some other method to determine which of these optimal individual conditions to implement to reach the optimal system design.

It is to be understood that the present invention is intended to encompass the design of any system that creates zero phase error between the firing of any two of the printhead elements and any disturbance in the system. Further, the present invention is intended to encompass any partial implementation of the methods described herein to achieve zero-phase error between any of the disturbances in a serial printing system and the resulting firing times of any of the print elements relative to any of the other print elements.

The present invention is illustrated herein as being used in conjunction with an ink jet printer. However, it is to be understood that the present invention applies to any system using a carriage of any kind to position sensors or mechanisms. Specifically, the present invention applies to any printing system that moves a carriage assembly across a page while printing.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A carriage drive system for use in a serial printer, said carriage drive system comprising:

a carriage movable in transverse directions across a print medium, each of the transverse directions being substantially perpendicular to a print medium feed direction;

at least one print cartridge releasably mounted on said carriage and having at least one printhead, said at least one printhead having at least one ink jetting nozzle for jetting ink, said at least one ink jetting nozzle being configured for cyclically jetting the ink at at least a first jetting frequency;

a carriage belt mechanically coupled to said carriage;

a transverse drive system for driving said carriage belt in the transverse directions; and a drive motor coupled to said drive system;

wherein at least one cyclical disturbance exists due to the operation of at least one of said carriage belt, said drive system and said motor, said at least one cyclical disturbance having at least a first disturbance frequency, at least one of said carriage belt, said drive system and said motor being configured such that said first disturbance frequency is an integer multiple of said first jetting frequency.

2. The printer of claim 1, wherein said at least one ink jetting nozzle comprises a plurality of ink jetting nozzles aligned in the transverse directions, said first jetting frequency comprising a frequency with which said aligned nozzles jet respective ink droplets onto the print medium.

3. The printer of claim 2, wherein said first jetting frequency comprises a frequency with which said aligned nozzles jet single, respective ink droplets onto a single pixel location on the print medium.

4. The printer of claim 2, wherein said cyclical disturbance has a substantially same phase at respective points in time at which said aligned nozzles jet the respective ink droplets onto the print medium.

5. The printer of claim 2, wherein said carriage belt includes a plurality of belt teeth, each said belt tooth being separated from an adjacent said belt tooth by a common belt tooth pitch distance, said first disturbance frequency being dependent upon each of said common belt tooth pitch distance and a speed at which said carriage belt is driven by said transverse drive system.

6. The printer of claim 5, wherein each said ink-jetting nozzle is separated from other said ink jetting nozzles by respective nozzle separation distances in the transverse directions, said common belt tooth pitch distance being a divisor of each of said nozzle separation distances.

7. The printer of claim 6, wherein said common belt tooth pitch distance is a divisor of a greatest common divisor of said nozzle separation distances.

8. The printer of claim 6, wherein said at least one print cartridge comprises a plurality of print cartridges, said nozzle separation distances including at least one distance between two said jetting nozzles on different, respective said print cartridges.

9. The printer of claim 5, wherein said transverse drive system includes at least one pulley having a plurality of pulley teeth configured for engaging said belt teeth, each said pulley tooth being separated from an adjacent said pulley tooth by a common pulley tooth pitch distance, at least one said disturbance frequency being dependent upon each of said common pulley tooth pitch distance and a speed at which said at least one pulley is driven by said drive motor.

10. The printer of claim 9, wherein each said ink-jetting nozzle is separated from other said ink jetting nozzles by respective nozzle separation distances in the transverse directions, said common belt tooth pitch distance being a divisor of each of said nozzle separation distances.

11. The printer of claim 10, wherein said common belt tooth pitch distance is a divisor of a greatest common divisor of said nozzle separation distances.

12. The printer of claim 1, wherein said first disturbance frequency is an integer multiple of each said jetting frequency.

13. The printer of claim 1, further comprising a frame slidably supporting said carriage, said drive motor being mounted to said frame.

14. A method of reducing print registration errors in a serial printer, said method comprising the steps of:

providing at least one print cartridge releasably mounted on a carriage and having at least one printhead, said at least one printhead having at least one ink-jetting nozzle;

cyclically jetting the ink from said at least one ink-jetting nozzle at at least a first jetting frequency;

coupling a carriage belt to said print cartridge;

driving said carriage belt in transverse directions across a print medium using a transverse drive system;

coupling a drive motor to said transverse drive system, at least one cyclical disturbance existing due to operation of at least one of said carriage belt, said transverse drive system and said motor, said at least one cyclical disturbance having at least a first disturbance frequency; and configuring said at least one print cartridge and at least one of said carriage belt, said drive system and said drive motor such that said first disturbance frequency is an integer multiple of said first jetting frequency.

15. The method of claim 14, wherein said at least one ink jetting nozzle comprises a plurality of ink jetting nozzles aligned in the transverse directions, said first jetting frequency comprising a frequency with which said aligned nozzles jet respective ink droplets onto the print medium.

16. The method of claim 15, wherein said first jetting frequency comprises a frequency with which said aligned nozzles jet single, respective ink droplets onto a single pixel location on the print medium.

17. The method of claim 15, wherein said cyclical disturbance has a substantially same phase at respective points in time at which said aligned nozzles jet the respective ink droplets onto the print medium.

18. The method of claim 16, wherein said carriage belt includes a plurality of belt teeth, each said belt tooth being separated from an adjacent said belt tooth by a common belt tooth pitch distance, said first disturbance frequency being dependent upon each of said common belt tooth pitch distance and a speed at which said carriage belt is driven by said transverse drive system.

19. The method of claim 18, wherein each said ink-jetting nozzle is separated from other said ink jetting nozzles by respective nozzle separation distances in the transverse directions, said common belt tooth pitch distance being a divisor of each of said nozzle separation distances.

20. The method of claim 19, wherein said common belt tooth pitch distance is a divisor of a greatest common divisor of said nozzle separation distances.

21. The method of claim 18, wherein said at least one print cartridge comprises a plurality of print cartridges, said nozzle separation distances including at least one distance between two said jetting nozzles on different, respective said print cartridges.

22. The method of claim 21, wherein said transverse drive system includes at least one pulley having a plurality of pulley teeth configured for engaging said belt teeth, each said pulley tooth being separated from an adjacent said pulley tooth by a common pulley tooth pitch distance, said first disturbance frequency being dependent upon each of said common pulley tooth pitch distance and a speed at which said at least one pulley is driven by said drive motor.

23. The method of claim 22, wherein each said ink-jetting nozzle is separated from other said ink jetting nozzles by respective nozzle separation distances in the transverse directions, said common belt tooth pitch distance being a divisor of each of said nozzle separation distances.

24. The method of claim 14, wherein said common belt tooth pitch distance is a divisor of a greatest common divisor of said nozzle separation distances.

25. The method of claim 14, wherein said first disturbance frequency is an integer multiple of each said jetting frequency.

26. The method of claim 14, comprising the further steps of:

providing a frame for slidably supporting said carriage; and mounting said drive motor to said frame.

* * * * *